US010266000B2

(12) United States Patent
Fee et al.

(10) Patent No.: US 10,266,000 B2
(45) Date of Patent: Apr. 23, 2019

(54) THUMB HOLE CONTAINER WITH TWIST AND LOCK LID STORAGE AND MAGNET

(71) Applicant: Nova Wildcat Shur-Line, LLC, Mooresville, NC (US)

(72) Inventors: Garry Fee, Huntersville, NC (US); John Morphey, Concord, NC (US)

(73) Assignee: NOVA WILDCAT SHUR-LINE LLC, Mooresville, NC (US)

( * ) Notice: Subject to any disclaimer, the term of this patent is extended or adjusted under 35 U.S.C. 154(b) by 0 days.

(21) Appl. No.: 15/254,117

(22) Filed: Sep. 1, 2016

(65) Prior Publication Data

US 2017/0057697 A1 Mar. 2, 2017

Related U.S. Application Data

(60) Provisional application No. 62/213,380, filed on Sep. 2, 2015.

(51) Int. Cl.

| | |
|---|---|
| ***B44D 3/12*** | (2006.01) |
| ***B65D 21/02*** | (2006.01) |
| ***B65D 25/28*** | (2006.01) |

(52) U.S. Cl.

CPC ..... *B44D 3/121* (2013.01); *B65D 21/0233* (2013.01); *B65D 25/2897* (2013.01); *B65D 2313/04* (2013.01)

(58) Field of Classification Search

CPC ..... B65D 25/2897; B65D 25/2802; B65D 21/0233; B65D 21/0222; B65D 21/0223; B65D 11/24; B65D 11/20; B44D 3/121; B44D 3/123; B44D 3/12

USPC ..... 220/736, 735, 770, 771, 904, 380, 675, 220/669; 206/509, 508, 504, 507, 506, 206/505, 519, 515

See application file for complete search history.

(56) References Cited

U.S. PATENT DOCUMENTS 1,331,409 A * 2/1920 Barnett ..... B65D 25/32 220/771
2,655,283 A * 10/1953 Moldt ..... B65D 21/045 206/507
2,994,457 A * 8/1961 Fornas ..... B65D 21/045 206/507
3,989,142 A * 11/1976 Gwilliam, Jr. ..... B65D 21/0219 206/508

(Continued)

FOREIGN PATENT DOCUMENTS

CN 202624838 U 12/2012

OTHER PUBLICATIONS

Office Action issued in related co-pending Canadian Application No. 2,940,933, dated Jun. 6, 2017.

(Continued)

*Primary Examiner* — Robert J Hicks
(74) *Attorney, Agent, or Firm* — McGuireWoods LLP

(57) ABSTRACT

An improved pail container includes a container body that includes an opening and a chamber that is configured to receive and hold, e.g., a liquid, and, a lid that is removably attachable to the container body; wherein the container body may include a base defining a bottom of the container body and a sidewall that is configured to project upward from the base and form the opening; wherein the base and the sidewall include the chamber; and wherein the container body includes at least one cavity for a user to hold the pail container.

20 Claims, 3 Drawing Sheets

(56) References Cited

U.S. PATENT DOCUMENTS

| | | | | |
|---|---|---|---|---|
| 5,150,804 | A * | 9/1992 | Blanchet | B65D 51/24 206/505 |
| 5,390,818 | A * | 2/1995 | LaBuda | B65F 1/068 141/390 |
| 7,938,292 | B2 | 5/2011 | Chornenky | |
| 2006/0243732 | A1* | 11/2006 | Bergman | B44D 3/126 220/757 |
| 2008/0190930 | A1* | 8/2008 | Vogel | B65D 21/0222 220/276 |
| 2009/0032542 | A1* | 2/2009 | Temple | B65D 25/30 220/669 |
| 2009/0095760 | A1* | 4/2009 | Chornenky | B44D 3/12 220/628 |
| 2009/0266738 | A1* | 10/2009 | Dunford | B65D 21/0233 206/515 |
| 2009/0277913 | A1* | 11/2009 | Bergman | B44D 3/126 220/570 |
| 2010/0077790 | A1* | 4/2010 | Apps | B65D 11/06 62/372 |
| 2012/0037634 | A1* | 2/2012 | Kiceniuk, Jr. | B44D 3/121 220/495.02 |
| 2014/0361026 | A1* | 12/2014 | Carnesecca | B65D 1/16 220/771 |
| 2017/0007012 | A1* | 1/2017 | Aide | A46B 15/0095 |
| 2018/0043732 | A1* | 2/2018 | Gringer | B44D 3/121 |

OTHER PUBLICATIONS

Office Action issued in related co-pending Canadian Application No. 2,940,933 dated Jan. 29, 2018.

* cited by examiner

THUMB HOLE CONTAINER WITH TWIST AND LOCK LID STORAGE AND MAGNET

This application claims benefit and priority to U.S. Provisional No. 62/213,380, filed on Sep. 2, 2015, the disclosure of which is incorporated by reference herein in its entirety.

FIELD OF DISCLOSURE

The present disclosure relates generally to a pail container, and more particularly, it relates to a pail container with improved usability comprising a container with easy store, twist lock storage lid, and an easy to control thumb carry hole.

BACKGROUND OF THE DISCLOSURE

Pail containers are often used to hold a variety of fluids and flowable materials such as, for example, paint, water, oil, and the like. Pail containers are available in wide array of sizes and shapes to meet various industrial needs. One issue with such container is that it is often difficult to hold and use the container simultaneously with ease. Pail containers typically include a handle or strap which requires two hands to use and can impact the container's use when used for, e.g., painting.

Accordingly, there exists an unfulfilled need for a pail container with an improved usability that can be used to apply, e.g., a paint, in an efficient manner with an improved control and handle.

SUMMARY OF THE DISCLOSURE

According to an aspect of the present disclosure, an improved pail container is disclosed. The pail container includes a container body that includes an opening and a chamber that is configured to receive and hold, e.g., a liquid, and, a lid removably attachable to the container body, wherein the container body includes a base defining a bottom of the container body and a sidewall that is configured to project upward from the base and form the opening, wherein the base and the sidewall comprise the chamber, and wherein the container body includes at least one cavity for a user to hold the pail container.

The base and the sidewall may be formed as one unit. In an alternative, the base and the sidewall may be formed as two separate units that may be connected by, e.g., screw, tape, nail, adhesive, and the like.

The container body may include at least one thread or lip on a top portion of the container body near the opening. The container body may include at least one connecting mechanism at the base.

The lid may include at least one thread or lip that may be used to removably attach to the at least one connecting mechanism, e.g., a thread, on the top of the container body. The lid may include yet another at least one connecting mechanism such as, e.g., a thread or lip that may be used to removably attach to at least one connecting mechanism on the base.

The container body may include a magnet that may be used to attach to a corresponding magnet or ferromagnetic material on, e.g., a tool such as a brush. The magnet may be placed inside the container body. The magnet may be located at a distance that is more proximate to the opening than the base.

The container body may be substantially translucent or transparent. The container body may include a material that is configured to flex in response to a force applied to the container body.

The at least one cavity may be formed on an external side of the container body.

The base may include a set of tactile ribs. The base may further include a clearance pocket. The base may be configured to contact a surface and support the container in a predetermined position.

The sidewall may include a substantially uniform thickness. The sidewall may taper such that the top portion of the container body may include a larger diameter compared to the bottom portion of the container body. In an alternative, the sidewall may taper such that the top portion of the container body may include a smaller diameter compared to the bottom portion of the container body.

In an embodiment of the present disclosure, the container body may be configured to receive and store another pail container through the opening in the chamber.

In another aspect of the present disclosure, a pail container is disclosed. The pail container includes a chamber that receives and holds, e.g., a liquid, and a container body that includes a base and a main body that has an annular side wall extending upward and outward from a periphery of the base, wherein the annular side wall forms the chamber, wherein the container body comprises an opening that provides access to the chamber and allows the liquid to be stored, and wherein the container body further includes at least one cavity for a user to easily hold and use the pail container. The chamber may be configured to receive and hold another pail container.

In one aspect, a pail container includes a lid that is removably attachable to a container body at a top and at a bottom of the container body, the container body comprising a base defining a bottom of the container body and comprising a sidewall that is configured to project upward from the base and form an opening, the container body further comprises a chamber defined by the sidewall and the base that is configured to receive and hold a liquid and at least one cavity proximate the base for a user to insert a digit to hold the pail container. The at least one cavity is may be configured to allow the user insert a thumb in order to hold the pail container for restraining the pail container on a hand of the user. The pail container may further comprise a pair of vertically oriented cavities formed along opposing sides of the container body. The pair of vertically oriented cavities may be open ended at the base. The pail container may further comprise a magnet configured within a slot area formed in an inner side of the container body proximate the top for holding a tool. The container body may be narrower in width proximate the base widening in width proximate the top. The pail container may further comprise a first connecting mechanism at the top for removably connecting the lid, and a second connecting mechanism at the base for connecting the lid to the base. The pail container may further comprising a set of ribs formed in the base for securing the lid to the base.

In one aspect, a method of providing a pail container includes providing a lid that is removably attachable to a container body at a top of the container body and at a bottom of the container body, providing a container body comprising a base defining a bottom of the container body and comprising at least one sidewall that is configured to project upward from the base and form an opening, the container body defining a chamber that is configured to receive and hold a liquid and configuring at least one cavity proximate the base for a user to insert a digit to hold the pail container. The method may further comprise forming a pair of vertically oriented cavities along opposing sides of the container body. The set for forming the pair of vertically oriented cavities may form an open end in the pair of vertically oriented cavities proximate the base. The method may further comprise arranging a magnet configured within a slot area formed in an inner side of the container body proximate the top for holding a tool. The step of providing a container body may provide a container body that is narrower in width proximate the base widening in width proximate the top. The method may further comprise providing a first connecting mechanism at the top for removably connecting the lid, and providing a second connecting mechanism at the base for connecting the lid to the base. The method may further comprise providing a set of ribs formed in the base for securing the lid to the base. The step of configuring at least one cavity proximate the base may mold the at least one cavity proximate the base. The step of providing a container body may form a pair of vertically oriented cavities on opposite outside walls of the container body and concave vertically oriented extensions on the inner wall of the container body permitting a second container body having a matching vertically oriented cavities on opposite outside walls to engage the concave vertically oriented extensions on the inner wall to orient the second container body.

In one aspect, a pail container includes a container body comprising a base defining a bottom of the container body and comprising a sidewall that is configured to project upward from the base and form an opening, the container body comprises a chamber defined by the sidewall and the base that is configured to receive and hold a liquid, at least one cavity proximate the base for a user to insert a digit to hold the pail container and a lid that is removably attachable to the container body at a top and at a bottom of the container body. The at least one cavity may be configured to allow the user to insert a thumb in order to hold the pail container for restraining the pail container on a hand of the user. The pail container may further comprise a magnet configured in an inner side of the container body proximate the top for holding a tool.

BRIEF DESCRIPTION OF THE DRAWINGS

The accompanying drawings, which are included to provide a further understanding of the disclosure, are incorporated in and constitute a part of this specification, illustrate embodiments of the disclosure and, together with the detailed description, serve to explain the principles of the disclosure. No attempt is made to show structural details of the disclosure in more detail than may be necessary for a fundamental understanding of the various ways it may be practiced. In the drawings.

DETAILED DESCRIPTION OF THE DISCLOSURE

The disclosure and the various features and advantageous details thereof are explained more fully with reference to the non-limiting embodiments and examples that are described and/or illustrated in the accompanying drawings. Features of one embodiment may be employed with other embodiments as the skilled artisan would recognize, even if not explicitly stated herein. Descriptions of well-known components and processing techniques may be omitted so as to not unnecessarily obscure the embodiments of the disclosure. The examples used herein are intended merely to facilitate an understanding of ways in which the disclosure may be practiced and to further enable those of skill in the art to practice the embodiments of the disclosure. Accordingly, the examples and embodiments herein should not be construed as limiting the scope of the disclosure.

The terms "including", "comprising" and variations thereof, as used in this disclosure, mean "including, but not limited to", unless expressly specified otherwise.

The terms "a", "an", and "the", as used in this disclosure, means "one or more", unless expressly specified otherwise.

Although process steps, method steps, or the like, may be described in a sequential order, such processes and methods may be configured to work in alternate orders. In other words, any sequence or order of steps that may be described does not necessarily indicate a requirement that the steps be performed in that order. The steps of the processes or methods described herein may be performed in any order practical. Further, some steps may be performed simultaneously.

Figure 1A:
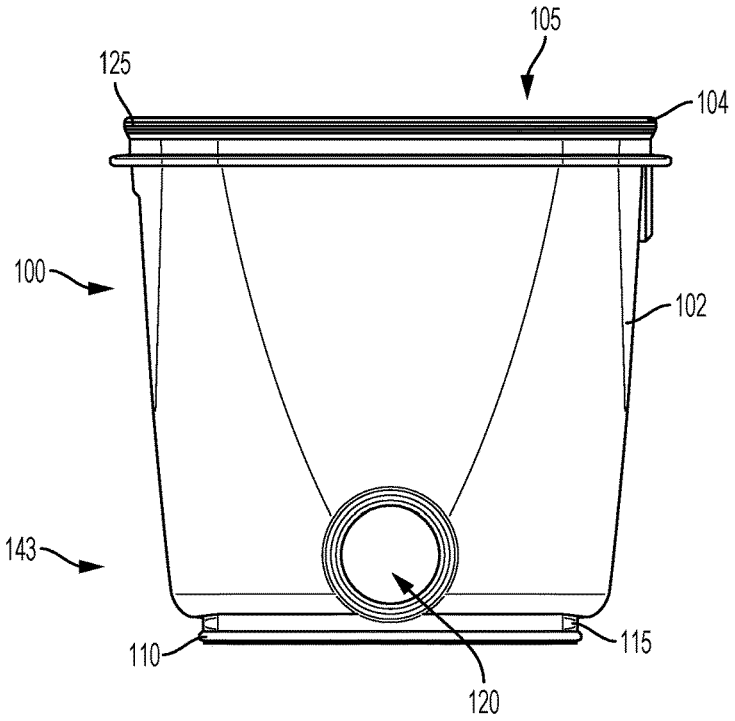
FIG. 1A is a side-view and FIG. 1B is a bottom view of a pail container 100, configured according to principles of the disclosure.
Figure 1B:
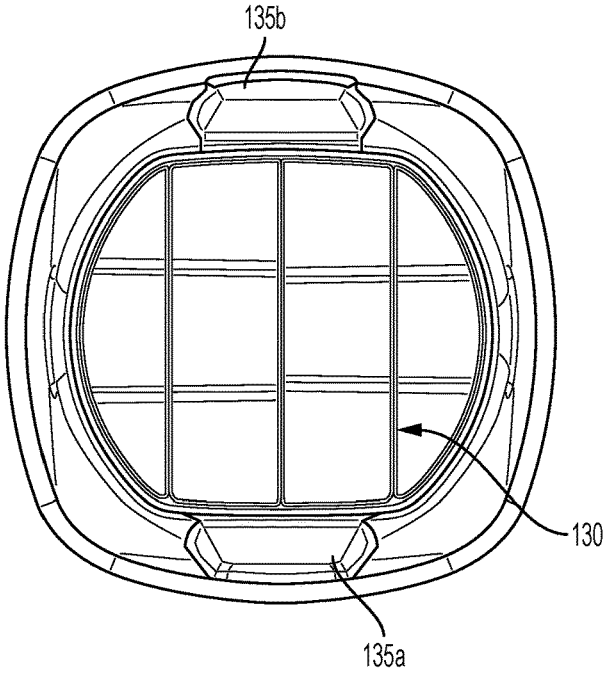
Figure 2:
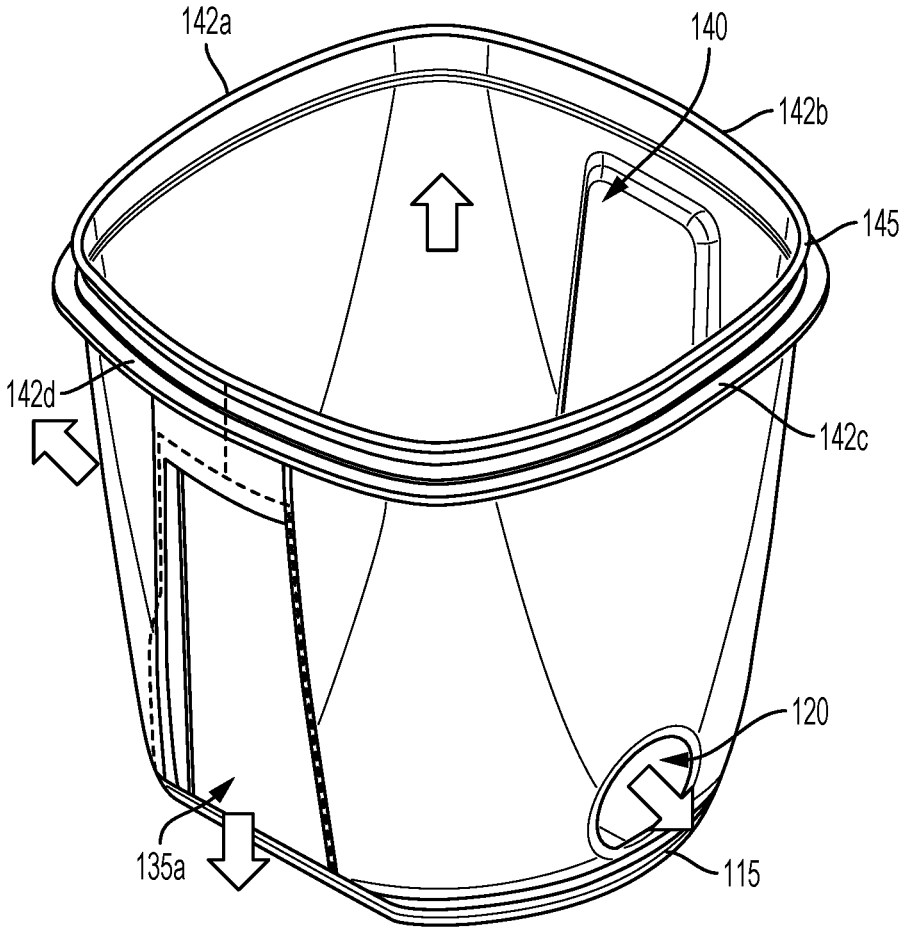
FIG. 2 is a perspective view of the pail container of FIG. 1A, configured according to principles of the disclosure.

FIG. 1A is a side-view and FIG. 1B is a bottom view of a pail container 100, configured according to principles of the disclosure. FIG. 2 is a perspective view of the pail container of FIG. 1A, configured according to principles of the disclosure.

The pail container 100 includes a container body 102 that includes an opening 105 proximate a top 104 of the container body 102 and a chamber 140 (FIG. 2) that is configured to receive and hold, e.g., a liquid, and a lid 150 (FIG. 3) that is removably attachable to the container body 102; wherein the container body 102 may include a base 110 defining a bottom of the container body 102 and a sidewall 142*a*, 142*b*, 142*c*, 142*d* (FIG. 2) that is configured to project upward from the base 110 and form the opening 105; wherein the base 110 and the sidewall 142*a*, 142*b*, 142*c*, 142*d* form the chamber 140; and wherein the container body 102 may include at least one holding cavity 120 for a user to hold the pail container 100. The at least one holding cavity 120 may be formed at a bottom portion 143 of the container body 102. The holding cavity 120 may extend inward from the sidewall 142*a*, 142*b*, 142*c*, 142*d* and may be configured in size to receive and envelop a thumb or finger of a user. The at least one holding cavity 120 is closed so that any fluid is retained within the container body 102. In different embodiments, the at least one holding cavity 120 may be sized for a smaller sized thumb or finger, and in another embodiment a large size for a larger thumb or finger.

The pail container may comprise, e.g., polypropylene (PP), thermoplastic elastomer (TPE), metal, wood, brick, cement, or the like. The liquid may include, e.g., a paint, a lacquer, a sealer, an ink, a varnish, a stain, a dye, or the like.

The base 110 and the sidewall 142*a*, 142*b*, 142*c*, 142*d* may be formed as one unit. In an alternative, the base and the sidewall may be formed as two separate units that may be connected by, e.g., screw, tape, adhesive, friction fit, screw-fit, or the like. The sidewall 142*a*, 142*b*, 142*c*, 142*d* may be connected to one another with a curved corner. A pair of opposing sidewalls, e.g., 142*b*, 142*d* may be configured with at least one cavity 135*a*, 135*b*, described more fully below. The at least one holding cavity 120 may be configured in one of the sidewalls 142*c*. The at least one holding cavity 135*a*, 135*b* may be configured in one of the sidewalls 142*b*, 145*d* creating concave vertically oriented extensions on the inner wall of the container body 102 that extend inwardly into the container body 102, permitting a second container body 100 having a matching vertically oriented cavities 135*a*, 135*b* on opposite outside walls of the container body 102 to engage the formed concave vertically oriented extensions on the inner wall to orient the second container body.

The container body 102 may include at least one connecting mechanism 125 such as, e.g., a thread, proximate the top 104 of the container body 102 proximate the opening 105. The at least one connecting mechanism 125 may be used to attach the container body 102 to a lid 150 which may include, e.g., a corresponding thread(s), groove(s), slot, and the like. The container body 102 may include at least one second connecting mechanism 115, such as, e.g., a thread on the base 110 which may be used to attach the container body 102 to the, e.g., corresponding thread(s), groove(s), slot, or the like, on the lid 150. The container body 102 and the lid 150 may attach to each other via a twist and lock mechanism. The container body 102 and the lid 150 may also be removably attached to each other via, e.g., a fastening mechanism, an adhesive, a friction fit, or the like. In the alternative, the container body 102 and the lid 150 may include snap-on lids via friction fit to attach to each other.

The lid 150 may further be configured such that it can only be rotated though a rotation angle of 180° in relation to the at least one connecting mechanism 125. In embodiments, the rotation angle may vary and may further include an angle of 0° to 360°. The lid 150 may further be configured such that it can only be rotated though a rotation angle of 45° to 90° in relation to the at least one connecting mechanism 125.

Figure 4A:
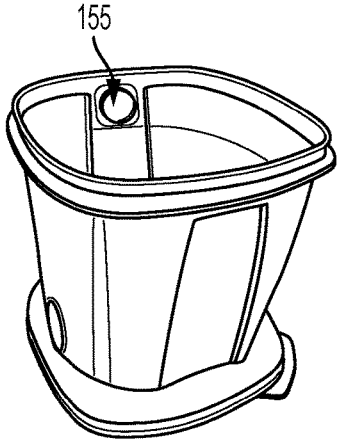
FIG. 4A is a perspective view of a pail container showing a magnet, configured according to principles of the disclosure.
Figure 4B:
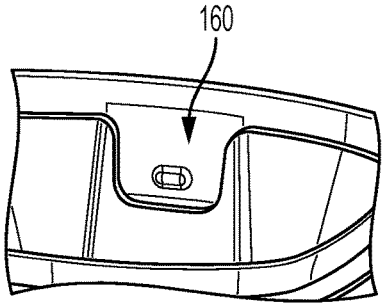
FIG. 4B is a close-up view of a slidable cover that may be utilized to cover the magnet of FIG. 4A, configured according to principles of the disclosure.
Figure 4C:
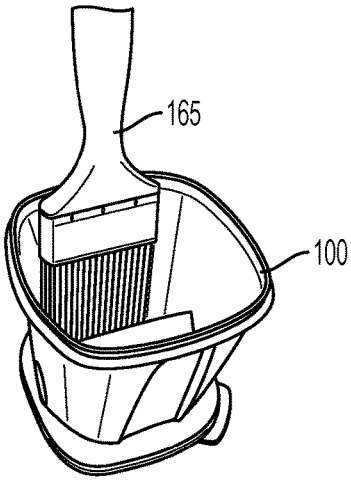
FIG. 4C is a perspective view of the pail container of FIG. 4A showing a paint brush held by a magnet, configured according to principles of the disclosure.

FIG. 4A is a perspective view of a pail container showing a magnet, configured according to principles of the disclosure. FIG. 4B is a close-up view of a slidable cover 160 that may be utilized to cover the magnet of FIG. 4A, configured according to principles of the disclosure. FIG. 4C is a perspective view of the pail container of FIG. 4A showing a paint brush held by a magnet, configured according to principles of the disclosure. The container body 102 may include a magnet 155 that may be used to attach to a corresponding magnet or ferromagnetic material on, e.g., a tool such as a brush 165. The magnet 155 may be placed inside the container body 102. The magnet 155 may be located more proximate to the opening 105 than to the base 110. The magnet 155 may be removably fixed onto the container body. In the alternative, the magnet 155 may be permanently fixed onto the container body. A slidable cover 160 may be utilized to cover the magnet 155. The slidable cover 160 may be configured to slide into a pair of channels along opposite sides of the magnet 155.

The container body 102 may be substantially translucent or transparent. The container body 102 may include a material that is configured to flex in response to a force applied to the container body.

The at least one cavity 135*a*, 135*b* may be formed on an external side of the container body 102. The at least one cavity 135*a*, 135*b* may be formed along the vertical length of the container body 102 with the at least one cavity 135*a*, 135*b* being open towards the base 110. At the opposite end of the at least one cavity 135*a*, 135*b*, the at least one cavity 135*a*, 135*b* may stop beneath and proximate the connecting mechanism 125. The at least one cavity 135*a*, 135*b* may permit one pail container 100 to be inserted into and received by another pail container 100, with some measure of controlling orientation, and friction fit to control movement. The at least one cavity 135*a*, 135*b* may be configured with sufficient depth to provide clearance of the magnet 155.

The base 110 of the container body 102 may include, e.g., a set 130 of tactile ribs, tabs, posts, or the like, that are adapted to interact with the lid 150. The lid 150 may include corresponding, e.g., ribs, tabs, posts, or the like, that may be used to facilitate coupling and/or locking of the lid 150 to the container body. The base 110 may be configured to contact a surface, e.g., a ladder, table, shelf or the like, and support the pail container 100 in a predetermined position, e.g., standing, or vertical orientation with opening 105 at the top.

The sidewall 142*a*, 142*b*, 142*c*, 142*d* may include a substantially uniform thickness. The sidewall 142*a*, 142*b*, 142*c*, 142*d* may taper such that the top 104 portion of the container body 102 proximate opening 105 may include a larger diameter or area compared to the bottom portion 143 of the container body 102, proximate base 110. In an alternative, the sidewall 142*a*, 142*b*, 142*c*, 142*d* may taper such that the top 104 portion of the container body 102 proximate opening 105 may include a smaller diameter compared to the bottom portion of the container body, proximate base 110.

The at least one holding cavity 140 may include an aperture wide enough for a thumb. This is a significant improvement over currently available pail containers because it improves the way that the pail containers are usually carried and supported. In an alternative, the holding cavity 140 may include an aperture wide enough to use, e.g., all four fingers. The at least one holding cavity 140 may be configured to include various shapes or dimensions, as may be utilized by a user's finger or thumb.

A typical pail container prior to this disclosure may use various straps or handles that result in the palm of the hand being roughly parallel to the side walls, which when combined with the weight and center of gravity of the fluid contained within, produce an arm or torque that works to twist the hand. This places additional strain on the hand over and above supporting the weight alone. In contrast, whether the features described herein be via a single thumb hole or multiple finger holes, the effect is the same; the palm of the hand is parallel to the bottom of the pail container 100, and is also positioned directly below it. The net positive effect is that there is no torque twisting the hand, so it is more comfortable, and the pail container 100 is more stable as the center of gravity is directly above the palm of the hand making it less likely to spill.

Figure 3:
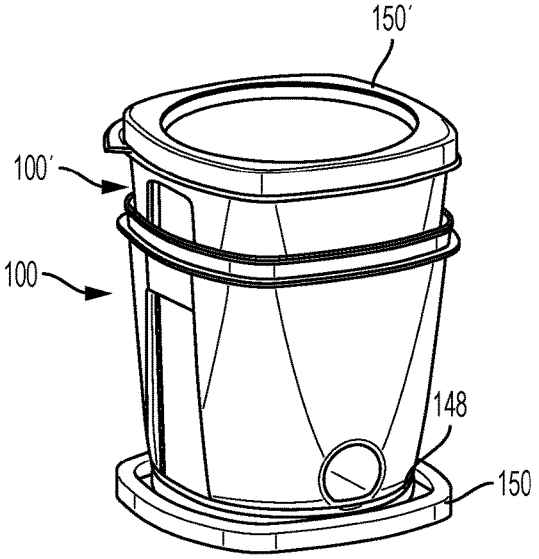
FIG. 3 shows one pail container 100' within another pail container 100, configured according to principles of the disclosure.

FIG. 3 shows one pail container 100' within another pail container 100, configured according to principles of the disclosure. The container body 102 may be configured to receive and store another pail container 100 through the opening 105. By nesting a pail container 100' inside another pail container 100, the pail containers can be stored more efficiently and save space. Moreover, the use and placement of the lids 150, 150' is illustrated. Lid 150 may also become a second base when secured to the base 110 by, e.g., second connecting mechanism 115.

In another aspect of the present disclosure, a pail container is disclosed. The pail container includes a chamber that receives and holds, e.g., a liquid, and a container body that includes a base and a main body that has an annular side wall extending upward and outward from a periphery of the base; wherein the annular side wall forms the chamber; wherein the container body comprises an opening that provides access to the chamber and allows the liquid to be stored; and wherein the container body further includes at least one cavity for a user to easily hold and use the pail container. The chamber 140 may be configured to receive and hold another pail container.

This present disclosure also provides a method of using a pail container 100. In the disclosed method, a user engages, e.g., a paint brush 165 into a pail container 100 which includes a container body 102 that may include an opening 105 and a chamber 140 that is configured to receive and hold a liquid, e.g., a paint, and a lid 150 that is configured to be removably attachable to the container body 102, and wherein the container body 102 and the base 110 form and comprise the chamber 140. The base 110 of the container body 102 may secure the lid for storage such as while a second container body 102 may be inserted into a first the container body 102 for storage.

The disclosure also provides a method for manufacturing a pail container 100. The pail container 100 which includes a container body 102 and a lid 150 may be manufactured by injection molding, injection stretch blow molding, thermoforming, extrusion blow molding, injection blow molding, insert molding, co-injection molding, rotational molding, and other methods known in the art.

While the disclosure has been described in terms of exemplary embodiments, those skilled in the art will recognize that the disclosure can be practiced with modifications in the spirit and scope of the appended claims. These examples are merely illustrative and are not meant to be an exhaustive list of all possible designs, embodiments, applications or modifications of the disclosure.

What is claimed is:

1. A pail container comprising:

a lid that is removably attachable to a container body at a top and at a bottom of the container body; and the container body having a circumferential connecting mechanism at the top of the container body for removably attaching the lid, the container body comprising a base defining a bottom of the container body and comprising a sidewall that is configured to project upward from the base and form an opening, the sidewall including a first sidewall opposing a second sidewall and a third sidewall opposing a fourth sidewall, the container body further comprises:

a chamber defined by the sidewall and the base and configured to receive and hold a liquid;

at least one circular holding cavity that is proximate the base and shaped and sized to receive and envelop a digit of a user, the at least one circular holding cavity formed in the first or second opposing side walls;

a magnet configured within a slot area formed in an inner side of the container body proximate the top for holding a tool;

and a cavity formed in each of the third and fourth opposing sidewalls, each cavity creating a concave vertical extension on an inner wall of the container body to permit a similarly constructed second container body to engage the vertically oriented extensions to orient the second container body by friction fit, wherein the container body comprises a flexible material.

2. The pail container of claim 1, wherein the at least one circular holding cavity is closed to retain the liquid within the chamber.

3. The pail of claim 1, wherein each cavity is open ended at the base.

4. The pail container of claim 1, wherein the container body is narrower in width proximate the base widening in width proximate the top.

5. The pail container of claim 1, further comprising a second connecting mechanism at the base for connecting the lid to the base.

6. The pail container of claim 1, further comprising a set of ribs formed in the base for securing the lid to the base.

7. The pail container of claim 1, wherein the concave vertical oriented extensions extend upwards from the base and stopping beneath and proximate the connecting mechanism.

8. The pail container of claim 1, wherein the magnet is removably fixed onto the container body.

9. The pail container of claim 1, wherein the bottom of the container body has a first surface area, and wherein the top of the container body has a second surface area that is greater than the first surface area.

10. The pail container of claim 1, wherein the bottom of the container body has a first surface area, and wherein the top of the container body has a second surface area that is less than the first surface area.

11. A method of providing a pail container comprising:

providing a lid that is removably attachable to a container body at a top of the container body and at a bottom of the container body;

providing a container body having a circumferential connecting mechanism at the top of the container body and the container body comprising a base defining a bottom of the container body and comprising at least one sidewall that is configured to project upward from the base and form an opening, the at least one side wall comprising a first and second opposing sidewalls, and a third and fourth opposing sidewalls, the container body defining a chamber that is configured to receive and hold a liquid, wherein the container body comprises a flexible material;

arranging a magnet onto the container body proximate the top;

configuring a circular holding cavity proximate the base and configured in each of the first and second opposing sidewalls, wherein each circular holding cavity is shaped and sized to receive and envelop a digit of a user; and forming a cavity in each of the third and fourth opposing sidewalls, each cavity creating a concave vertical extension on an inner wall of the container body to permit a second similarly constructed container body to engage the vertically oriented extensions to orient the second container body by friction fit.

12. The method of claim 11, wherein each cavity is the only open ended cavity formed in each of the third and fourth opposing sidewalls proximate the base.

13. The method of claim 11, wherein the step of providing a container body provides a container body that is narrower in width proximate the base widening in width proximate the top.

14. The method of claim 11, further comprising providing a first connecting mechanism at the top for removably connecting the lid, and providing a second connecting mechanism at the base for connecting the lid to the base.

15. The method of claim 11, further comprising providing a set of ribs formed in the base for securing the lid to the base.

16. The method of claim 11, wherein the step of configuring at least one cavity proximate the base molds the at least one cavity proximate the base.

17. The method of claim 11, wherein in the step of forming a cavity, the concave vertical oriented extensions extend upwards from the base and stopping beneath and proximate the connecting mechanism, and are open ended proximate the base.

18. A pail container comprising:

a container body having a circumferential connecting mechanism at the top of the container body comprising:

a base defining a bottom of the container body;

a sidewall that is configured to project upward from the base and form an opening, the sidewall including a first side wall opposing a second sidewall and a third sidewall opposing a fourth sidewall; and a chamber defined by the sidewall and the base and configured to receive and hold a liquid;

a circular holding cavity formed in the first or second sidewall that is proximate the base and extends inward from the sidewall;

a cavity formed in each of the third and fourth opposing sidewalls, each cavity creating a concave vertical extension on an inner wall of the container body to permit a second similarly constructed container body to engage the vertically oriented extensions to orient the second container body by friction fit;

a magnet configured to an inner side of the container body proximate the top for holding a tool;

and a lid that is removably attachable to the container body at a top and at a bottom of the container body, wherein the circular holding cavity is shaped and sized to receive and envelop a digit of a user holding the container body, and wherein the container body comprises a flexible material.

19. The pail container of claim 18, wherein the circular holding cavity is closed to retain the liquid within the chamber.

20. The pail container of claim 18, wherein the magnet is removably fixed onto the container body.

* * * * *